US005110017A

United States Patent [19]

Braun

[11] Patent Number: 5,110,017

[45] Date of Patent: May 5, 1992

[54] CONTAINER WITH CAPTIVE CAP AND INTERNALLY VALVED CLOSURE AND POSITIVE CLOSURE SEALS

[75] Inventor: Morris Braun, Chicago, Ill.

[73] Assignee: W. Braun Company, Chicago, Ill.

[21] Appl. No.: 744,254

[22] Filed: Aug. 13, 1991

Related U.S. Application Data

[62] Division of Ser. No. 396,934, Aug. 22, 1989, Pat. No. 5,038,967.

[51] Int. Cl.[5] ..... B65D 47/00

[52] U.S. Cl. ..... 222/520; 222/549; 215/218; 215/256; 215/331; 401/208; 401/268

[58] Field of Search ..... 222/153, 187, 519, 520, 222/521, 549, 552, 553; 215/218, 221, 307, 310, 314, 318, 337, 338, 256, 330, 331; 401/213, 208, 268

[56] References Cited

U.S. PATENT DOCUMENTS

| | | | |
|---|---|---|---|
| 730,367 | 6/1903 | Hall | 222/519 |
| 757,912 | 4/1904 | Grapewine | 222/519 |
| 920,273 | 5/1909 | Coons | 222/519 |
| 1,590,822 | 6/1926 | Heath | 222/519 |
| 2,165,825 | 7/1939 | Bultzingslowen | 215/339 |
| 2,915,227 | 12/1959 | Quint | 222/519 |
| 3,261,515 | 7/1966 | Luedtke | 222/520 |
| 3,317,093 | 5/1967 | Moran | 222/519 X |
| 3,542,258 | 11/1970 | Marchant | 222/520 |
| 4,289,248 | 9/1981 | Lynn | 215/307 X |
| 4,412,634 | 11/1983 | Bennett | 222/519 |
| 4,927,065 | 5/1990 | Beck | 222/520 |
| 5,038,967 | 8/1991 | Braun | 222/519 |

FOREIGN PATENT DOCUMENTS

| | | | |
|---|---|---|---|
| 318820 | 12/1969 | Sweden | 222/519 |

*Primary Examiner*—Michael S. Huppert
*Assistant Examiner*—Gregory L. Huson
*Attorney, Agent, or Firm*—Michael G. Berkman

[57] ABSTRACT

A one-piece closure cap for a dispensing container. The cap, which is captive on the container body, is threadedly mounted for restricted rotation on the neck of the container so that upon elevation of the cap there is established a product release passage from the mouth of the container through product discharge ports formed in a surmounting top wall of the cap. Mechanical stops are provided to limit the degree of threaded rotation of the closure cap on the neck of the container to preclude inadvertent separation of the cap from the body of the container. The container neck is also formed adjacent an upper end thereof with a radially outwardly extending annular sealing bead which engages and stressingly abuts a circumscribing facing inner wall of the cap to prevent contents of the container from contaminating the threads of the closure assembly.

15 Claims, 6 Drawing Sheets

528
530
524
520
502
514
510

502

524
502

502
524

544
540
550
560
28
28
580
584
570

540
550

540
556
562
560
554
570

564
570
550

570
550

570
550

CONTAINER WITH CAPTIVE CAP AND INTERNALLY VALVED CLOSURE AND POSITIVE CLOSURE SEALS

CROSS REFERENCE TO RELATED APPLICATION

This application is a Divisional Application of pending prior application Ser. No. 07/396,934 which was filed on Aug. 22, 1989 in my name for Container with Captive Cap and Internally Valved Closure, and which issued on Aug. 13, 1991 as U.S. Pat. No. 5,038,967.

The entire disclosure of that patent application is hereby specifically incorporated herein by reference to the extent it is not inconsistent herewith.

FIELD OF THE INVENTION

The present invention relates to an internally valved dispenser and closure assembly which includes a one-piece closure cap. More particularly, the invention is directed to a closure cap which is threadedly mounted for restricted rotation on the neck of a dispensing container so that upon elevation of the cap there is established a product release passage from the mouth of the container through product discharge ports formed in a surmounting top wall of the cap. Once the dispenser container and the closure cap are assembled, the latter is not removable from the container.

The closure assembly of the invention is characterized in that there are provided cooperating threading elements and grooves or slots with auxiliary components which serve effectively as guides, mechanical impediments, and interference elements, or stops to ensure positive opening and closing, functional physical intercoupling, and fluid-tight sealing and proper operative manipulability of the container closure mechanism, in use.

Dispensing containers of the type which may be opened and closed in a positive mechanical manner without removal of the cap are known in the art. Such cap and container combinations have taken various forms, invoking many different structural arrangements. In one such series of closure assemblies rotation of the cap serves to establish a registry between ports in a top wall of the closure cap itself and in a disc surmounting the neck of the container. Such arrangements have included structures in which either a single passage or delivery port or multiple product releasing passages are established. In general, only a fractional turn is required in such structures to achieve the desired porting or dispensing mode.

Generally, such structures rely upon the establishment and maintenance of contiguously abutting areal surfaces and the establishment of product-sealing contact between an underface of a top wall of the cap and the top face of a disc which surmounts and closes the container fitment so that no leakage occurs when the assembly is in a sealed, "non-dispensing" configuration of the closure. Another objectionable feature of such closure arrangements is that a relatively high rotational or turning torque is required rotatably to shift the cap between dispensing and closed positions. Assembly of the closure cap onto the container also poses difficulties, and in many of the structures it is necessary to deform or shape the base of the closure cap in a final spinning operation to ensure establishment of a positively assembled combination.

Yet another deficiency of many of the prior containers and their closure tops or caps is an absence of positive mechanical guides in visually perceptible locations on the cap and/or the container itself to aid the user in the proper operation of the closing and opening mechanism of the assembly and to obviate inadvertent application of disruptive or destructive force.

In spite of the long existing and widespread interest in containers with closure assemblies of the general type referred to above, no structures completely satisfactory in all respects exist. In many specific embodiments the mechanisms are unduly complex leading to excessive production costs and difficulties in assembly. In others, the closures do not provide positive sealing, and leakage occurs. In still other arrangements, manipulation of the closure or cap between dispensing and closing modes in inconveniently difficult. In yet other closure assemblies there is no positive assurance of the exact position of the cooperating elements of the dispensing assembly, and whether in a dispensing or in a sealing configuration. Others of prior dispensing assemblies fail to include mechanisms for holding the closure cap captive on the container body, or for limiting the extent to which the product dispensing paths are opened. In many of the prior art structures, the physical arrangement of intercoupled components is such that the interengaging threaded elements become contaminated with the contents of the container, leading to difficulty in the operation of the mechanism.

It is, therefore, the aim of the present invention to provide, for use with a product storage and dispensing container, a closure assembly which obviates many of the inadequacies and shortcomings of the prior art devices.

SUMMARY OF THE INVENTION

The present invention provides a one-piece closure cap for a dispensing container, the cap being threadedly and captively mounted for restricted rotation on the container neck. Rotation of the cap effects controlled elevation of the cap to establish a product release and dispensing passage extending from the mouth of the container through product discharge routes to ports formed in a surmounting top wall of the cap. In preferred embodiments of the invention, the container neck is formed adjacent an upper end thereof with a radially outwardly extending annular sealing bead which engages and stressingly abuts a circumscribing facing inner wall of the cap, establishing a wiping seal to prevent the contents of the container from contaminating the threads of the closure assembly.

In each embodiment of the present invention the closure constitutes a single component cap which is threadedly rotatable on the neck of the container itself between a downwardly displaced or lowered position in which the cap seals the container and an upwardly displaced raised position in which there is established a dispensing path by which the contents of the container may be discharged through ports in the cap itself.

In a preferred embodiment of the invention the container neck is formed with a thread-like, closed-end, pitched groove communicating with a vertically extending generally V-shaped slot open at each of its opposed ends. The wider upper end of the slot accepts a cap-carried lug. The latter is positionable and is dimensioned for forced passage through the slot, including through the constricted base of the slot to enter upon and to ride within the groove of the container neck when the cap is initially assembled onto the container.

Yet another feature of the lug, slot and groove combination is that a wall bounding the thread-like groove is formed at the base thereof with one or more pips which project to seat in turn, in a cooperating mating notch formed in the lug, at an underside thereof.

A related feature of the V-shaped slot through which the cap-carried lug is forcibly inserted into the thread-like groove of the neck is that the lower limit of the walls which bound the slot defines an opening having an expanse which is less than that of the lug forcibly inserted therethrough, thereby to deter removal of the cap from the container, after initial assembly.

In one preferred embodiment of the invention the container is formed, in a zone adjacent the base of the neck with an upwardly directed deformable protrusion. A boss extending laterally of the closure cap at a lower edge thereof abuttingly engages to bear upon, forcibly depress, and override the protrustion when the closure cap is initially installed in position on the container during assembly of the dispenser.

A related feature of the protrustion and the boss combination is that the protrusion is of a hollow construction and depressible to deform during initial forced travel thereover, and then returns resiliently to its original configuration, whereby the protrusion serves effectively as a positive mechanical stop preventing inadvertent removal or separation of the cap from the container neck after initial assembly.

Yet another significant feature of the container-carried, integrally-formed protrusion at the upper shoulder zone of the container is that it is generally C-shaped or hook-shaped and arcuate, providing an elevating, arced top face over which the boss rides in a camming mode when the cap and container are first assembled. The protrusion presents a concave configuration including an overhanging hook-like lip for preventing unregulated reverse travel of the boss, limiting the extent of elevation of the cap, and deterring complete unthreading of the cap, thus preventing mechanical separation of the closure cap from the container body itself.

In preferred embodiments of the invention limit stops are provided to delineate fully opened and completely sealed configurational modes of the cap assembly.

It is a feature of several embodiments of the invention that limit stops for controlling the extent to which the closure cap can be elevated are so placed as to be visually evident, thus preventing inadvertent, forced override.

It is a related feature of the invention that stops are provided to limit the annular rotation of the closure cap of the container to an arc of less than 360 degrees.

In one embodiment of the invention the limit stops for controlling the degree of lift of the closure cap with respect to the top of the neck of the container consist of a pair of concentric rings carried respectively on the neck of the container and on the closure cap, the rings being so disposed and sized as abuttingly to engage when the closure cap is elevated to establish a dispensing mode of the container.

In yet another embodiment of the invention the limit stops include cooperating mechanically interfering post and boss elements carried respectively by the container and by the closure cap.

A feature of the closure caps of the invention is that secondary sealing of the ports in the top walls of the closure cap is achieved through mechanical abutment of the ports to overlie and sealingly to engage a top circumscribing edge or land of the neck of the fitment of the container.

A related feature of the invention is that upon elevating the cap through rotation thereof, the ports in the top wall of the cap establish flow communication with the interior of the container itself so that product may be dispensed therefrom, through the container cap.

It is a feature of the closure assembly of the invention that as the cap is threaded downwardly onto the neck of the container, an annular sealing ring or flange depending downwardly from the cap invades and enters the neck of the container sealingly to engage the neck interiorly thereof for establishing a fluid-tight seal to preclude spillage of the contents of the container when the closure is in a sealing mode.

It is an important feature of the invention that the neck of the container is formed, in a zone thereof above the circumscribing threads, with an annular wiping ring or bead which bears against a facing inner wall of the cap to establish a wall-wiping seal between the neck of the container and a skirt of the cap to prevent entry of container-stored product upon the threads of the assembly.

In one embodiment of the invention, the cap includes bristles projecting upwardly from a top wall thereof for application to a surface as scrubbing elements upon delivery of product to the bristles from the container.

Yet another feature of the invention is an annular flange which circumscribes and is integrally formed with the neck of the container to define a mechanical stop for limiting upward displacement or retraction of the cap during threaded rotation of the cap to an opened position of the container.

In one embodiment of the invention, the cap is formed with a removable retaining band attached to a circumambient lower end of the skirt of the cap. The band includes a radially inwardly directed flange which is keyed into a cooperating annular groove circumscribing the neck at the base thereof so that in its initial configuration the band prevents inadvertent premature elevation of the cap to a product releasing mode of the closure.

Other and further features, objects and advantages of the invention will become evident from the following description considered in conjunction with the drawings.

DETAILED DESCRIPTION OF ILLUSTRATED EMBODIMENTS

Figure 1:
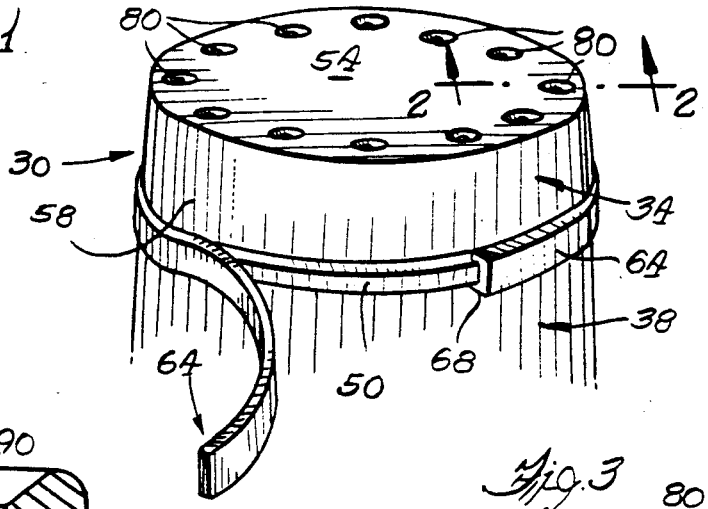
FIG. 1 is a perspective view of one embodiment of a closure according to the invention and indicating schematically a cap-securing safety seal and the manner of its removal from a dispensing container.

The aims and objects of the invention are accomplished by providing, in combination with a container, a one-piece closure cap which is threadedly secured at the neck of the container and which is formed with a circumscribing inwardly-directed flange precluding inadvertent removal from the container itself. The threaded cap is shiftable or retractable between a lowered position in which dispensing ports in a top wall of the cap abut and seal against an upper surface or land of the container neck. In the closed position of the cap, a sealing ring integrally formed with the cap penetrates and abuts an inner bounding upper edge of the mouth of the container effecting a positive seal precluding discharge of the contents from the container. In an elevated disposition of the cap, there is established a through passage between the discharge ports of the cap and the interior of the container, permitting release of the stored product.

Preferred embodiments of the invention are characterized in that the container and the closure cap are formed with cooperating elements which serve to prevent separation of the cap from the container after initial assembly. In one mechanical arrangement the container neck includes a circumscribing thread-like, endwalled groove in communication with a transverse, generally V-shaped slot. The slot opens upwardly for receiving a cap-carried lug forced therethrough. That is, the lug is sized to permit forced insertion downwardly through the slot for entry into to traverse the groove in the container neck. The constricted zone at a lower end of the slot obviates reentry of the lug into the slot, thus preventing separation of the cap from the container proper. Projections formed in the base of the groove, at each of opposed extremities thereof, mate with a cooperating notch in the lug so as releasably to retain the cap, selectively in each of the extreme limits of travel of the captive lug in the thread-like groove.

Another important feature of the closure assembly of the invention is that the neck of the container is integrally formed with a radially outwardly directed sealing bead which stressingly abuts an opposed inner surface of the cap establishing a wiping seal which prevents the contents of the container from coming into contact with to contaminate the threads of the closure. In one embodiment of the cap, there is provided a frangible ring or band which secures the cap in place to prevent premature retraction of the cap and associated unintended release of the contents from the container.

Referring more particularly to the drawing, there are shown, for the purpose illustrative disclosure and not in any limiting sense, preferred embodiments of the closure assembly of the invention incorporating the teachings thereof. In one embodiment of the invention depicted in FIGS. 1 through 5, the internally valve closure assembly 30 consists of a one-piece top 34 which surmounts a container 38, each being circular in transverse section. The generally cylindrical body 40 of the container 38 carries a neck 44 integrally formed with the container body 40 and being circumscribed externally with threads 48 and a base flange 50. Adjacent the top of the neck is provided an integral, radially outwardly directed wiping ring 52 the function of which is more fully described herebelow.

Figure 2:
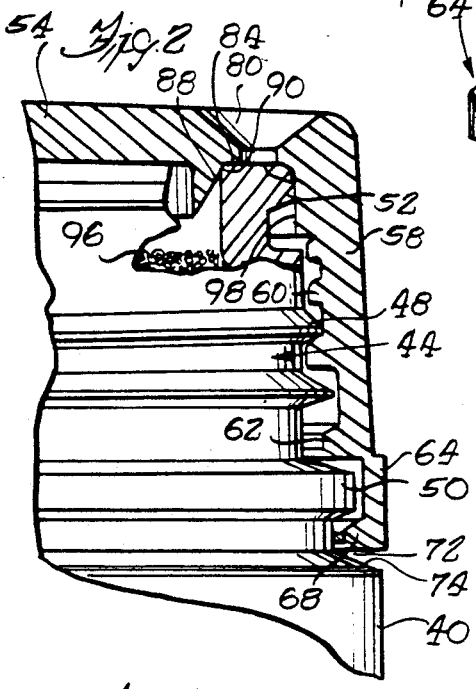
FIG. 2 is an enlarged fragmentary, cross-sectional view taken substantially on the lines 2—2 of FIG. 1 and showing the closure cap in a closed mode to seal the product dispensing ports formed in a top wall of the cap.
Figure 3:
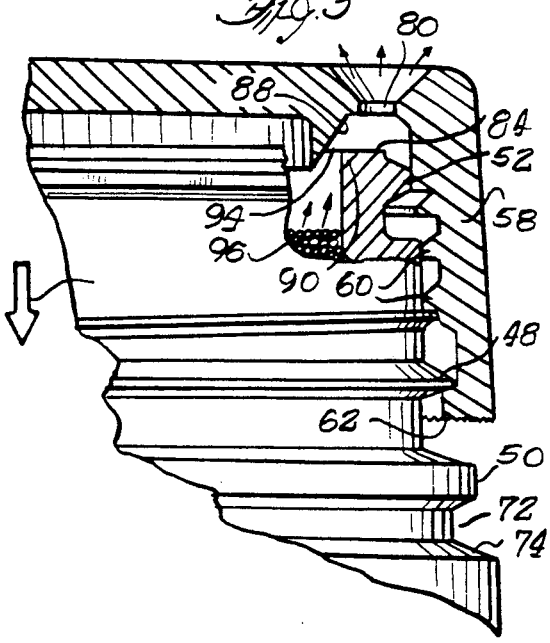
FIG. 3 is an enlarged, fragmentary view similar to FIG. 2 but with the safety seal tab removed and the closure threadedly retracted to an elevated position to define a product dispensing orientation of the assembly.
Figure 4:
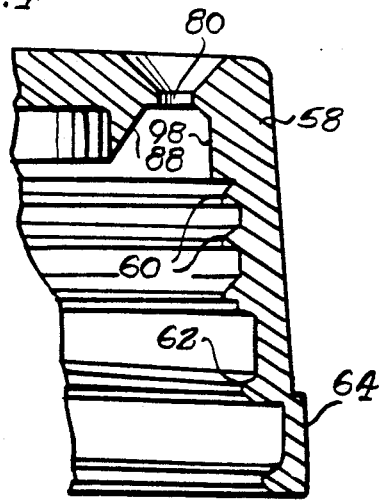
FIG. 4 is an enlarged, fragmentary, cross-sectional view of the cap of FIGS. 1 and 3.
Figure 5:
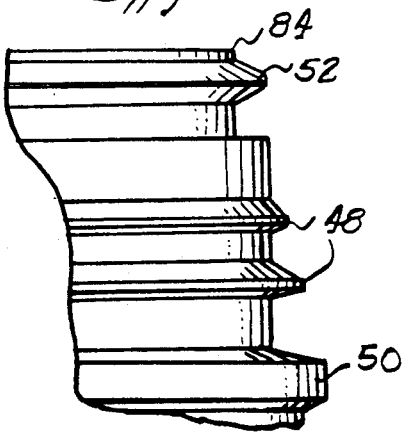
FIG. 5 is an enlarged, fragmentary, elevational view of the neck of the container of FIGS. 1 through 3 and showing the neck-carried, cap-abutting annular sealing bead for preventing product of the container from contaminating the threads of the closure assembly.

The cap 34 of the closure assembly includes a top wall 54 and an integrally formed depending skirt 58, the latter being formed with threads 60 on its interior face, and with a travel-limiting bead 62 as shown in FIGS. 2 through 4. As shown in FIGS. 1 and 2, the closure 34 is formed with a pull tab or locking band 64 at a lower circumambient end of the cylindrical wall 58 of the cap 34. The band 64 has a radially inwardly projecting lower flange 68 which seats and locks within an annular groove 72 of the container and which is bounded by the base flange 50 of the neck 44 of the container and a shoulder 74 surmounting the cylindrical body wall 40 of the container 38. Prior to putting the dispensing apparatus in use, the band 64 is forceably separated, as indicated schematically in FIG. 1.

As shown in FIG. 1, the top 54 of the cap 34 is formed with a plurality of through ports 80 disposed in an annular array and equally spaced from a center axis of the cap and in overlying registry with the top surface or land 84 of the neck 44 of the container. Depending from an underside of the top wall 54 of the cap 34 is an annular sealing ring 88 which engages the neck 44 of the container at an upper annular and interior edge 90 thereof when the cap 34 is threadedly advanced onto the neck 44 to close the receptacle, as shown in FIG. 2. Upon retracting the cap 34 upwardly, the ring 88 separates from the corner 90 of the neck 44 to establish a passage 94 (FIG. 3) through which container-stored product 96 is dispensed. As shown in FIGS. 2 and 3, irrespective of whether the assembly is in a sealed or in a dispensing configuration, the radially outwardly projecting annular ring 52 firmly abuts and seals against the opposed interior face 98 of the wall 58 of the cap 34 to prevent the contents 96 of the container 38 from reaching and contaminating the threads 48 and 60 of the container neck 44 and the cap 34.

Figure 6:
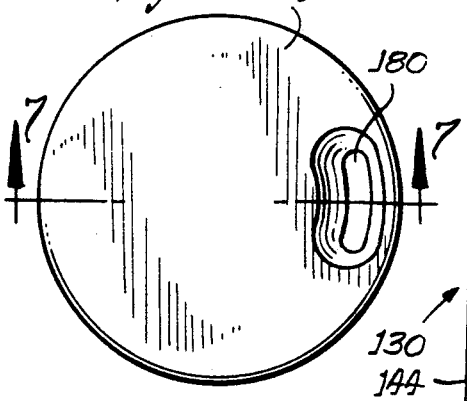
FIG. 6 is a top plan view of a second embodiment of a dispenser cap, according to the invention.
Figure 7:
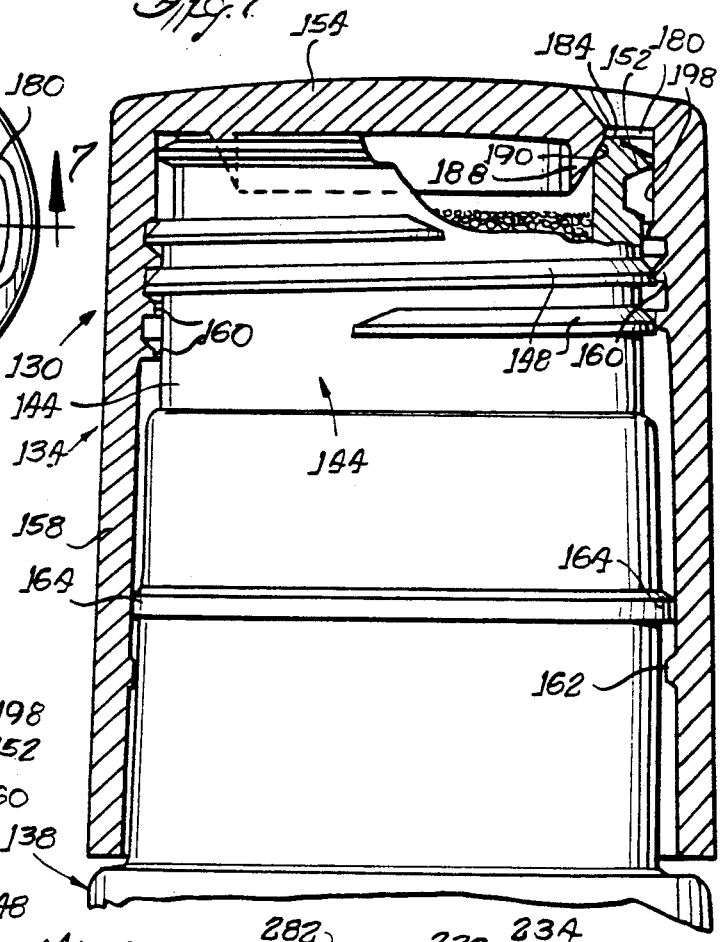
FIG. 7 is an enlarged, cross-sectional view taken substantially on the liens 7—7 of FIG. 6 and showing the closure of the invention in a container-sealing mode.
Figure 8:
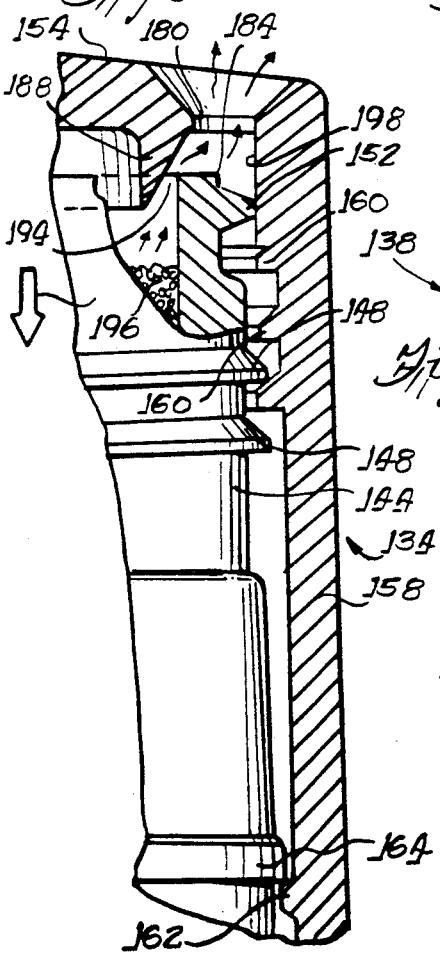
FIG. 8 is an enlarged, fragmentary, cross-sectional view showing the closure of FIGS. 6 and 7 in a product-dispensing configuration.

A second embodiment of a closure and dispensing assembly according to the present invention and illustrated in FIGS. 6 through 8 shows the assembly 130 as including a cap 134 surmounting the container body 138. The neck 144 of the container 138 has integrally formed threads 148 and a ring-like, bead or wiping band 152. The threads 148 of the neck 144 mesh with cooperating threads 160 of the cap 134, all as previously described. The cap 134 is formed near its lower end with an inwardly directed annular ring 162 which, upon threaded retraction of the cap 134 abuts a stopring 164 circumscribing the neck 144, the top ring 164 serving as a mechanical stop defining the appropriate product-releasing configuration of the assembly when it is in a dispensing mode.

The top 154 of the cap 134 is formed with a through port 180 which, in the particular embodiment of the invention illustrated, is generally oval in configuration and overlies the top edge or land 180 of the neck 144 so that upon closing the container by advancing the cap 134 downwardly, the opening 180 is sealed, as indicated in FIG. 7. Also, as there shown, the cap includes a downwardly projecting annular sealing ring 188 which comes into mechanical engagement to seal against a laterally presented upper top edge 190 of the container neck 144.

There is no criticality in the particular shape or areal expanse of the dispensing port 180 in the top wall 154 of the cap 134. It is important, however, that the porting be restricted to an annular zone which is radially outwardly displaced as to be beyond an area which overlies the open neck 144 and within radial limits delineated by the sealing ring 188. Within the above proscriptions, the port 180 may consist of an array of openings.

Referring now to FIG. 8, which shows the dispenser in its open or product releasing mode, with the cap 130 threadedly elevated, a passage 194 is established from the interior of the container and the product 196 stored therein, to the dispensing port 180. As previously described, throughout the entire closing and opening manipulation, the bead or ring-like band 152 stressingly abuts and rides upon the interior wall face 198 of the cap 134 to prevent the contents 196 of the container from coming into contact with the threads 148 and 160 of the container neck 144 and of the cap 134.

Figure 9:
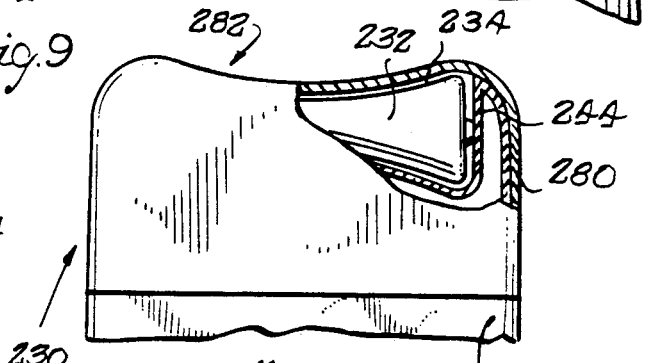
FIG. 9 is a front elevational view, with parts cut away, and depicting yet another embodiment of a closure, according to the invention, and including a rotatably mounted applicator bounded by a concave applicator surface.
Figure 10:
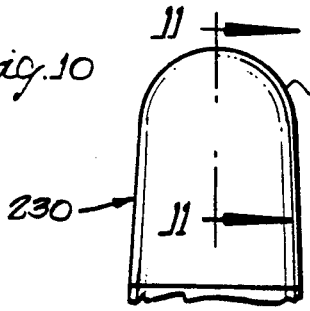
FIG. 10 is a side elevational view showing the overcap of FIG. 9.
Figure 11:
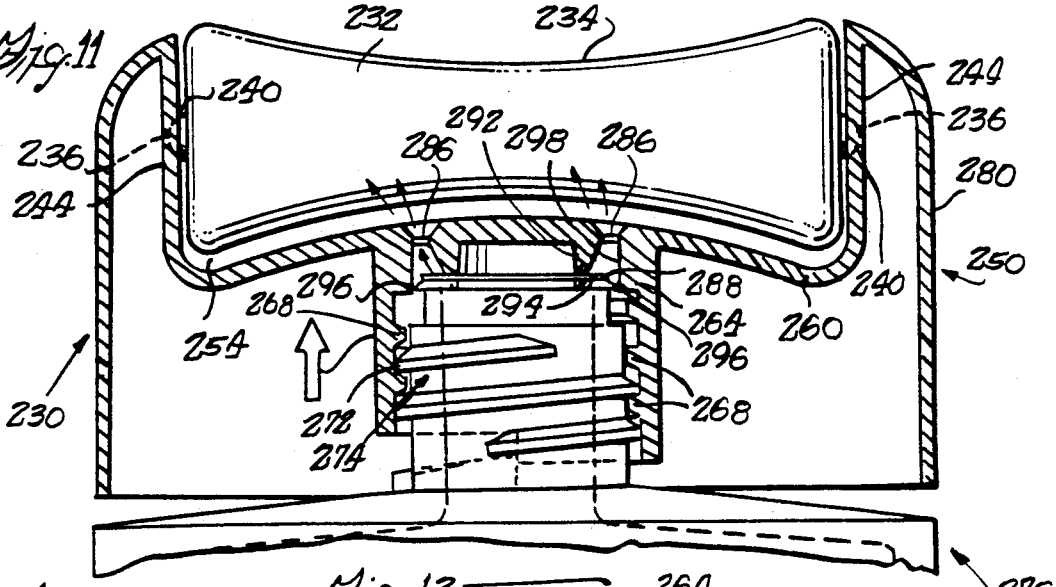
FIG. 11 is an enlarged, cross-sectional view taken substantially along the lines 11—11 of FIG. 10 with the overcap removed and showing the closure of FIG. 10 with the applicator cap retracted to a product releasing position.

Referring now to FIGS. 9 through 11, the closure assembly 230 includes a roll-on "dog bone" applicator 232 having a concave applicator surface 234, the applicator 232 being supported at each of its opposed ends by means of stub shafts 236 rotatably received in cooperating recesses 240 formed in opposed interior walls 244 of the applicator head 250. The head 250 defines a crater-like applicator-receiving cavity 254, applicator support walls 244. Integrally formed with and depending from the floor or base wall 260 of the assembly is an annular skirt 264 carrying internal threads 268 which threadedly mesh with cooperating threads 272 formed externally on a neck 274 of the container 276. A generally cylindrical wall 280 circumscribing the applicator assembly is joined at its upper end to the walls 244, as shown in FIG. 11. The applicator head 250 is surmounted by an overcap 282, which seats on a shoulder 284, circumscribing the container 276 at its upper end.

The base wall 260 bounding the cavity 254 is formed with a series of through ports 286 disposed in an annular array and overlying the land 288 of the container neck 274 so that the ports 286 are effectively sealed upon threadedly advancing the applicator assembly 250 onto the neck 274 of the closure device 230. As previously described, a sealing ring 292 integrally formed with and depending from the base wall 260 of the assembly 250 enters into the mouth of the neck 274 to engage an upper inner edge 294 of the container neck 274 to prevent discharge of contents from the container when the latter is in a closed mode. As in the embodiments of the invention previously described, the closure assembly 230 is formed at an upper annular zone of the neck 274 with a ring-like bead or band 296 which abuts and sealingly engages to bear upon an opposed inner wall surface 298 of the capping skirt 264 to prevent material stored in the container 276 from contaminating the threads 272 and 268 of the bottle neck 274 and the surmounting skirt 264.

Figure 12:
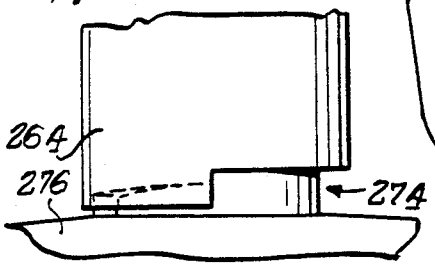
FIG. 12 is a fragmentary, elevational view of the closure of FIGS. 9-11 in place on a container neck and indicating a container-carried stop for controlling and limiting the extent to which the applicator closure cap can be retracted.
Figure 13:
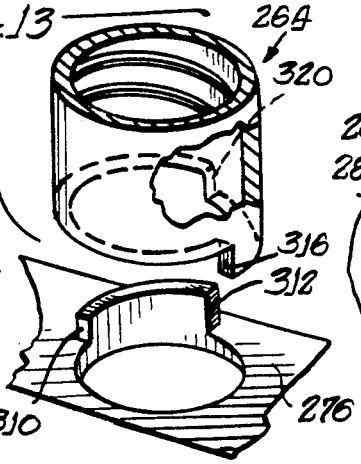
FIG. 13 is an exploded, perspective view, with parts cut away, showing a dispenser cap according to the invention and a cooperating thread arrangement and stops defining open and closed positions of the dispenser cap.
Figure 14:
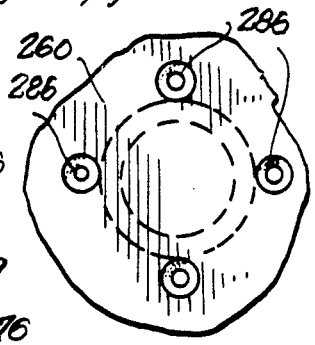
FIG. 14 is an enlarged, fragmentary plan view showing an arrangement of product dispensing ports in a cap in one form of a closure, according to the invention.
Figure 15:
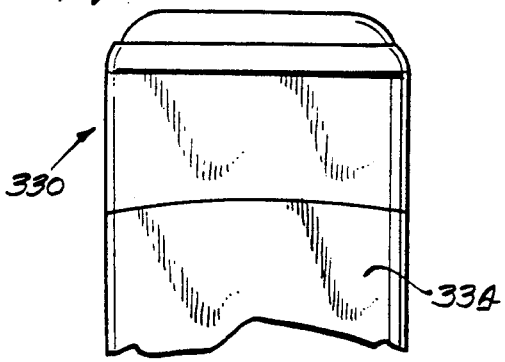
FIG. 15 is a front elevational view of a closure for a cylindrical roll-on applicator, according to the invention.
Figure 16:
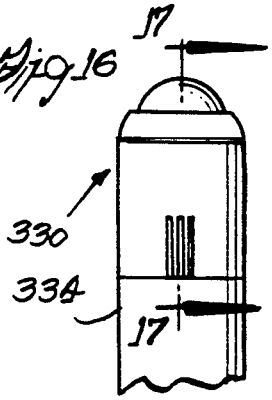
FIG. 16 is a side elevational view of the closure of FIG. 15.
Figure 17:
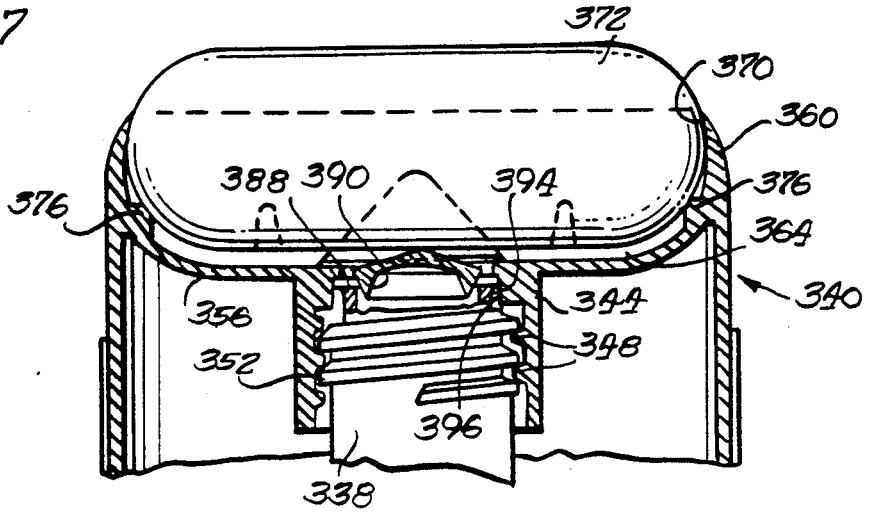
FIG. 17 is an enlarged, cross-sectional view taken substantially on the lines 17—17 of FIG. 16 and showing the applicator cylinder rotatably secured in the closure cap, and the closure in a close mode.
Figure 18:
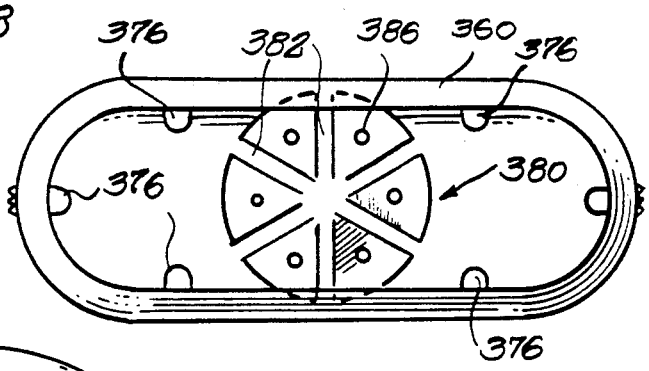
FIG. 18 is a top plan view of the applicator head of FIGS. 15-17.

As indicated in FIGS. 12 and 13, the neck 274 and the threadedly mounted surmounting skirt 264 are formed with abutment faces or stops 310, 312 and 316, 320 to regulate and control the degree of elevation of the cap 230 in its dispensing mode.

Yet another form of the closure assembly of the invention, embodying the features thereof, is shown in FIGS. 15 through 18, illustrating an oval roll-on applicator surmounting a container. As shown, the container assembly 330 includes a body 334 surmounted by a threaded neck 338. The applicator assembly 340 is formed with an internally threaded skirt 344 the threads 348 of which meshingly engage cooperating threads 352 carried by the container neck 338. Surmounting and integrally formed with the tubular skirt 344 is a disc-like base wall 356 extending generally ellipsoid sidewall 360 defining an upwardly opened cavity 364 with a somewhat restricted mouth 370.

An oval applicator 372, forceably inserted into the cavity 364 is retained within the cavity by the upper bounding edge of bearing stubs 376 so that the applicator 372 is rotatable about its elongated longitudinal axis.

In a zone overlying the mouth of the container neck 338 the base wall 356 of the chamber 364 is formed with a circular, disc-like section 380 formed with raised radial ribs 382 and a plurality of through recessed ports 386 disposed in a radial array about a center of the disc 380. As previously described, the ports 386 overlie for registration with the upper edge or land 388 of the neck 338 so that the ports 386 are closed when the assembly is in its downwardly displaced, sealing mode on the container neck 338. Depending from the base wall 356 of the applicator assembly 340 is a sealing ring 390 for engaging the interior upper edge of the bottle neck, as previously described. Also, as previously described, the neck 338 is formed with a radially outwardly projecting annular bead or band 394 which stressingly bears upon and seals against a facing inner wall surface 396 of the skirt 344 to prevent material stored in the container from contaminating the threads of the closure assembly.

Figure 19:
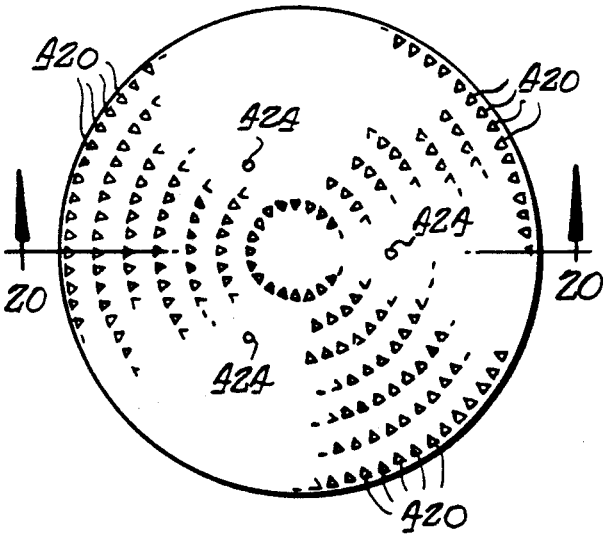
FIG. 19 is a top plan view of a scrub brush dispensing cap, in accordance with the present invention.
Figure 20:
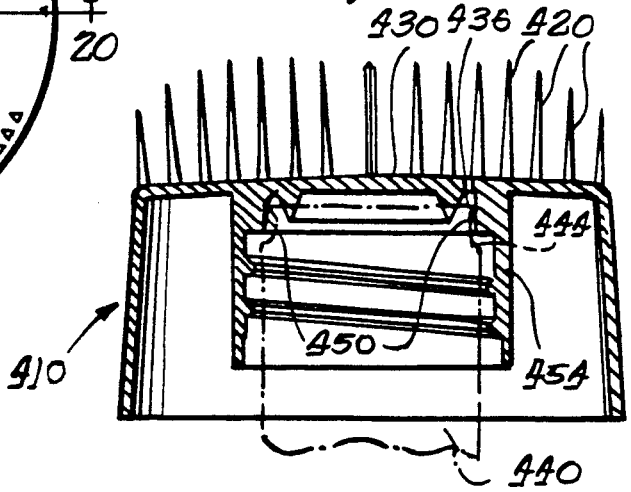
FIG. 20 is a vertical cross-sectional view taken substantially along the lines 20—20 of FIG. 19 and showing the cap-carried scrub bristles.
Figures 21, 22, 23, 24, 25, 26, 27, 28, 29, 30:
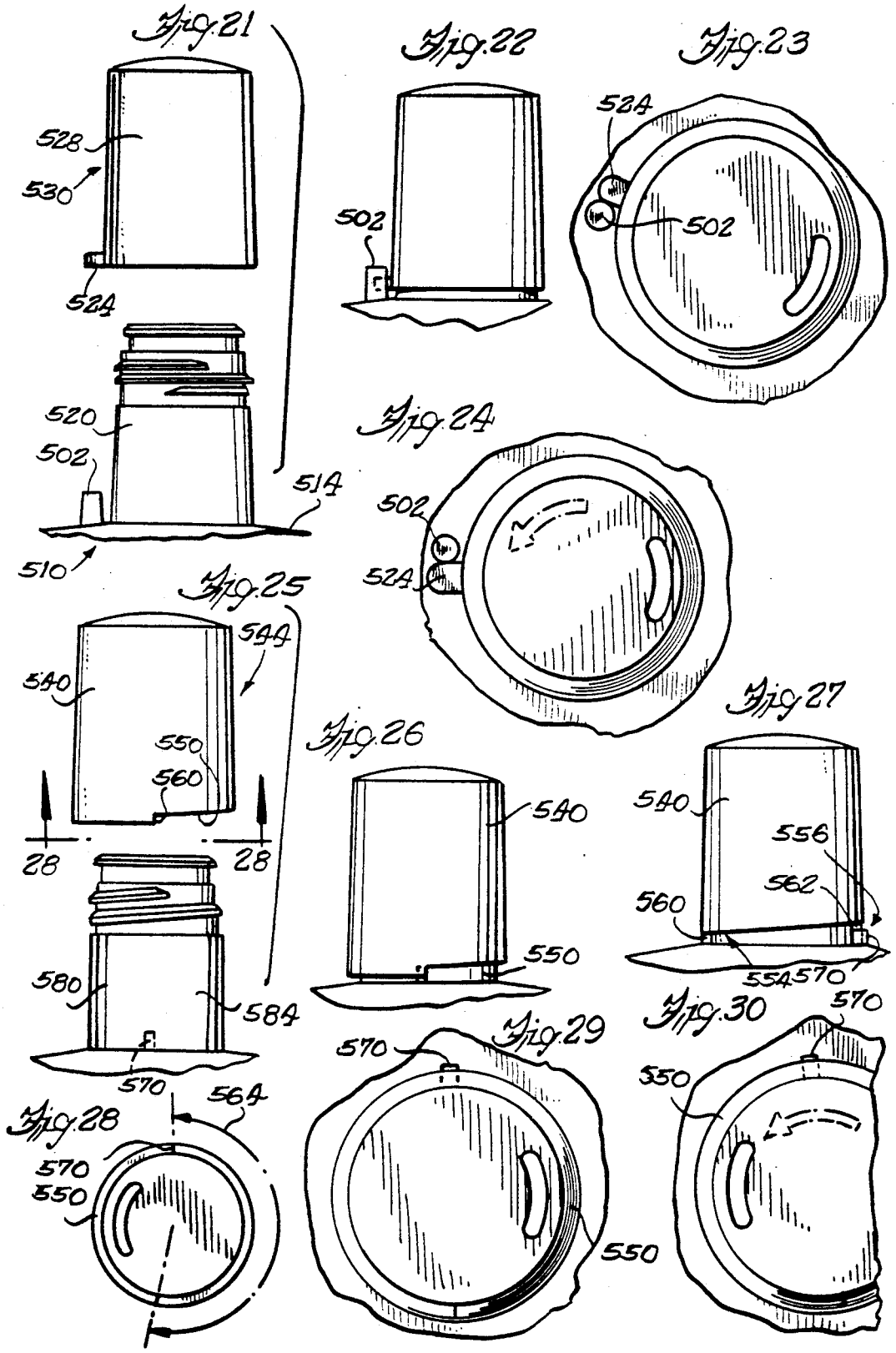
FIG. 21 is an exploded, elevational view of a container neck and a cap and showing visible cooperating stops on the finish and on the cap to limit the extent of rotational elevation of the cap with respect to the top of the container.
FIG. 22 shows the cap of FIG. 21 is position on the container neck, and the cooperating stops in abutment, at an open mode of the dispensing cap.
FIG. 23 is a top plan view of the closure assembly of FIG. 22 and showing the cap in a dispensing mode.
FIG. 24 is similar to FIG. 23, but depicting the cap in a container sealing mode.
FIG. 25 is an exploded, elevational view of a container neck and cap and showing a cap notched along a sector of its lower edge to form steps defining abutment stops for engaging a post mounted at a base of the container neck.
FIG. 26 is an elevational view of the cap and container of FIG. 25 in an assembled configuration and with the cap in a closed configuration.
FIG. 27 is a side view of the assembly of FIG. 26.
FIG. 28 is a top plan view of the closure assembly of FIG. 16 indicating schematically the extent to which the cap may be rotated to established a dispensing mode of the container.
FIG. 29 is a top view of the assembly of FIG. 26 showing the cap and finish in a closed position.
FIG. 30 is a top view of the assembly of FIG. 26 showing the cap and finish in a open position.
Figure 34:
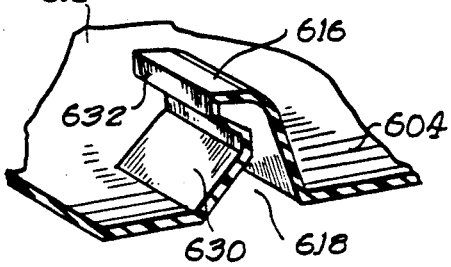
FIG. 34 is an enlarged, fragmentary, cross-sectional perspective view of the stop shown in FIGS. 31 and 32.
Figure 31:
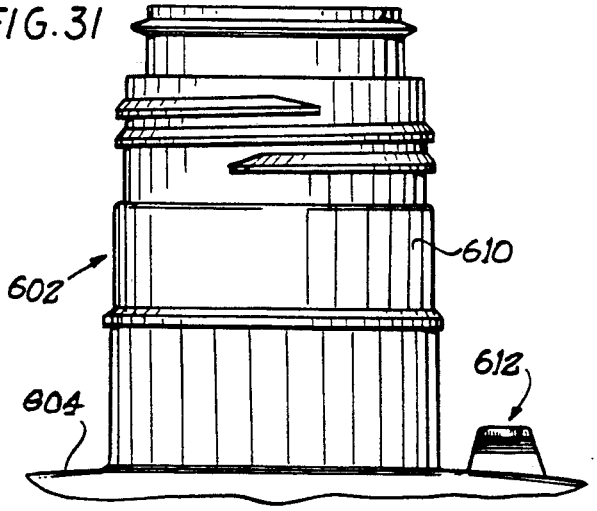
FIG. 31 is a front elevational view of yet another embodiment of the invention and showing a neck shoulder-carried for limiting rotation of a closure cap carried on the container neck and for retaining the cap captive on the container.
Figure 32:
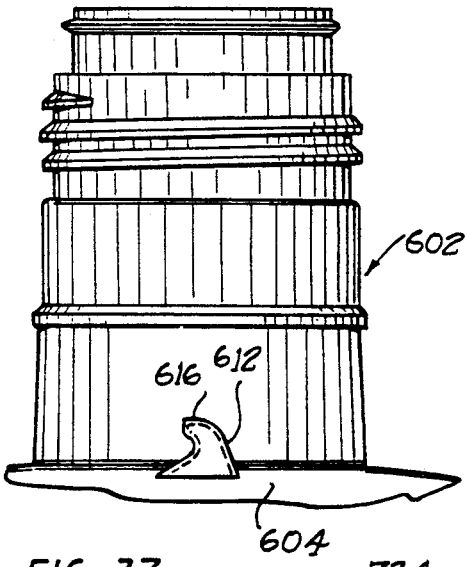
FIG. 32 is a side elevational view of the container neck of FIG. 31 and showing the hook-like cap-engaging stop.
Figure 33:
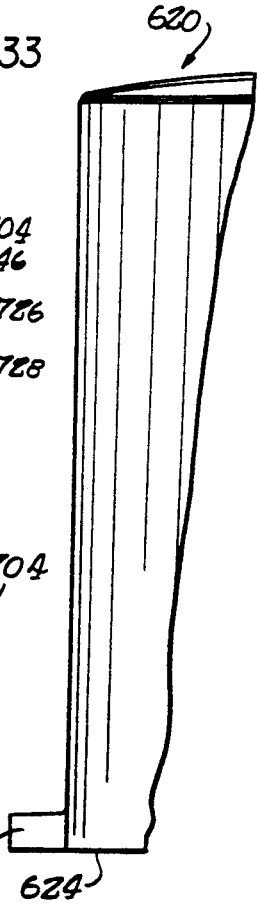
FIG. 33 is a fragmentary view of a container top or closure formed at its base with a boss for bearing upon and over riding the container neck carried stop.
Figure 35:
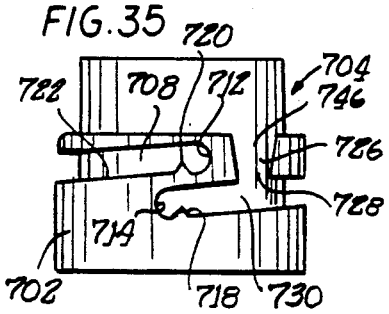
FIG. 35 is an enlarged front elevational view of a container neck in accordance with another embodiment of the invention and showing a pitched circumscribing thread-like groove having a restricted access slot.

FIG. 19 and 20 provide a schematic representation of a closure cap 410 from the upper, applicator surface of which a plurality of bristles 420 extend. Through ports 424 extend through a top wall 430 of the cap 410. the fluid feed ports 424 are in spatial registry with the top edge surface or land 436 of the neck 440 of the container, in a manner previously described, so that the ports 424 are sealed when the top is in its downwardly threaded mode. In accordance with principles previously set forth in the embodiment of the invention shown in FIGS. 19 and 20, the container neck 440 is formed with a radially outwardly projecting sealing bead or band 444 which stressingly abuts and sealingly engages the opposed inner wall surface 450 of the threaded skirt 454 depending from the top wall 430 of the closure cap 410.

In preferred embodiments of the invention, mechanical stops are provided to limit the height to which the closure cap of the dispensing assembly can be displaced upwardly of the neck of the container when the assembly is oriented to assume a product dispensing mode or configuration. In the previously described form of the invention, a limit stop structure in the form of an annular bead 62 has been described. The bead is integrally formed with the skirt 58 of the cap 34, as shown in FIG. 3.

Various other arrangements establishing limit stops are indicated schematically in FIGS. 7 and 8, FIGS. 12 and 13, and in FIGS. 21-30. As shown in FIGS. 7 and 8, there is provided a pair of interfering rings or beads 162 and 164. A first ring 164 is integrally formed with and circumscribes the neck 144 of the container exteriorly therearound. A second ring or annular shoulder 162 is formed on an inner wall surface of the cap 134 at a height which is below the neck ring 164. The outer diameter of the neck ring 164 is greater than an inner diameter of the cap shoulder 162 so that the extent to which the cap 134 may be theadedly elevated is controlled.

The stop arrangement shown in FIGS. 21-24 has the advantage that the interfering elements are visually evident. A post 502 is carried by the finish 510 of the container, projecting upwardly from an annular shoulder 514 at the base of the container neck, and a boss 524 is secured to and extends outwardly of the skirt 528 of the cap 530 at a lower marginal zone of the cap and at a level which is substantially the same as that of the post 502. Rotation of the cap 530 brings the boss 524 into abutment against the post 502, permitting an arcuate displacement which is somewhat less than a full 360 degrees of arc, and thus restricting the degree of elevation of the cap 530.

In the structure of FIGS. 25-30 the cap skirt 540 of the cap 544 is cut out or otherwise notched or shaped on its under edge to define an annular sector 550 forming arcuately spaced steps 554 and 556 including vertical abutment walls 560 and 562. As the cap 544 is rotated through an arc 564, a wall 562 of the cut-out sector 550 comes into positive engagement with a post-like stop 570 formed integrally with the wall 580 of the container neck 584 at a lower extremity thereof.

In accordance with the present invention, other mechanical structures are invoked, by means of which the closure cap is retained on the container body so that inadvertent separation is precluded. The structures are described below with reference to FIGS. 31 through 38.

Referring now to FIGS. 31-34, there is shown another mechanical arrangement, in accordance with the invention, by which a closure cap. The retained against physical separation from the cooperating bottle or container, and which, at the same time, limits the extent of elevational travel or lift of the cap. The container or dispenser 602 is formed on a shoulder 604 thereof adjacent the upstanding threaded 606 neck 610 with an arcuate, generally, hook-shaped, upstanding protrusion 612 having a convex top surface 616. It is an important feature of the invention that the generally C-shaped protrusion is hollow 618 and is resiliently deformable or depressible upon application of downwardly directed forces thereagainst.

The closure or cap 620 which threadedly surmounts the neck 610 of the container 602 is formed at its base 624 with a laterally outwardly extending rigid wing or boss 626. As the cap 620 is threadedly advanced on the neck 610 of the container, during initial assembly of the structure, the boss 626 is brought into abutment against stressingly to bear upon the convex top surface 616 of the protrustion 612. Continued advance of the closure cap 620 causes the boss to cam upon and to travel over and forcibly temporarily to depress or distort the protrusion as the boss overrides the impediment presented. A concave configuration 630 and overhanging lip 632 on the lee side of the protrusion 612 presented to the boss 626 during retracting rotation of the cap 620 of the assembly to serve effectively as a mechanical stop to limit the degree of elevation of the cap 620 from the dispenser itself. The closure cap 620 remains captive on the container 602 body.

In the embodiment of FIGS. 35 through 38, a circumscribing thickened wall 702 of the neck 704 of a container 706 is formed with a pitched, thread-like, annular groove 708 bounded by end walls 712 and 714. Pips or wedge-like protrusions 718 and 720 integrally formed with the container wall 602 project upwardly of a floor 722 of the groove 708 and invade the groove 708 adjacent respective end walls 712 and 714 thereof. An upwardly flared generally V-shaped slot 726 formed in the wall 702 of the neck 704 communicates at a lower constricted end 728 with a lower channel portion 730 of the thread-like groove 708.

Figure 37:
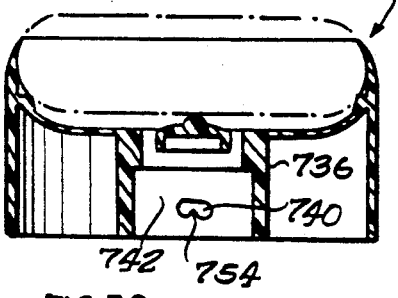
FIG. 37 is a vertical cross-sectional view of a closure cap positionable onto to lock on the container neck of the FIG. 35 embodiment of the invention, and showing the cap-carried lug which, upon forced entry, traverse the thread-like groove of the container neck.
Figure 36:
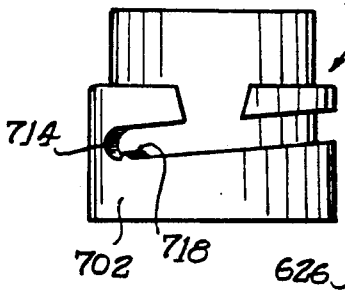
FIG. 36 is a view similar to FIG. 37 as viewed from a different annular perspective.
Figure 38:
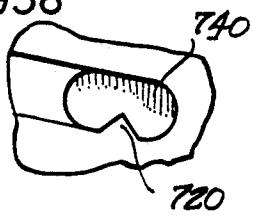
FIG. 38 is an enlarged fragmentary view indicating the manner in which a notched cap-carried lug engages a mating pip formed in the threadedly grooved container neck to hold the cap at a limit of its annular travel on the container neck.

The cap or closure 734 for the container 704 includes a skirt 736 formed with a lug 740 which projects radially inwardly of a principal interior surface 742 of the skirt 736. The lug 740 is dimensioned to permit ready entry into the mouth 746 of the slot 726 while establishing an interference fit with respect to the constricted lower end 728 of the slot 726. Application of pressure downwardly onto the cap 734 is effective to force the lug 740 through the slot 726 and beyond the constriction 728 to enter the groove 730. The restricted port 728 at the base of the slot 728 prevents withdrawal of the lug 740 upwardly through the slot 726. The cap 734 is thus held captive on the container neck 704, and upward and downward movement of the cap 734 with respect to the container 704 is delineated and limited by the pitched or convolute path defined by the thread-like groove 708. As shown in FIGS. 37 and 38 the lug 740 is formed at an under surface thereof with a notch 754 which matingly selectively receives therewithin the pips 718 and 720 at each of the opposite travel limits of lug 740 within the groove 708. The "interlock" established functions releasably to restrain the closure cap 734 at each of its fully closed and its fully open positions.

While the present invention has been described with reference to several preferred embodiments, it is to be understood that the invention is not limited to such embodiments and that the scope of the invention is defined in the appended claims.

What is claimed is:

1. An open-top container and a captive closure cap surmounting said container, said container having a container body and a neck integral therewith, and said neck being formed with an upwardly open top defining a filling and discharge opening for said container;

an upstanding annular wall of said neck being formed with continuous external thread means for engaging cooperating intercoupling means carried by said closure cap;

said closure cap bridging said neck of said container and including a top wall and an annular skirt depending from said top wall;

annular wiping bead means integrally formed on said neck of said container adjacent an upper limit of said neck, said wiping bead means including a vertically-extending, bounding perimetric end face in contiguous abutment with an opposingly-presented vertical inner wall of said cap for establishing a sustained, wall-wiping sliding contact seal between said end face of said wiping bead means and said wall of said cap in an annular sector above said threads of said neck as said cap is threadedly advanced downwardly toward, and retracted upwardly from, said body of said container;

said bead means projecting radially outwardly of said neck and biased to abut and stressingly to bear against an inside surface of said skirt of said cap for preventing entry of product onto to contaminate said threads upon discharge of product from said container;

sealing ring means for establishing a fluid-tight, line-contact seal of said closure cap with said container at said filling and discharge opening of said container;

said sealing ring means comprising annular flange means integrally formed with and depending from an underside of said top wall of said cap for stressingly engaging and positively sealing against a cooperating annular circumscribing upper interior edge of said container upon threadedly advancing said cap downwardly onto said neck of said container to close said container;

said flange means defining a downwardly projecting annular rib formed with an upwardly and outwardly flared circumscribing outer annular wall for penetrating entry of said flange means into said neck of said container for stressingly engaging said neck about said upper interior edge thereof for establishing a definitive line-contact seal of said cap with said container along a locus circumscribing said annular wall of said flange means of said cap;

and stop means for mechanically deterring separation of said closure cap physically from said container when said cap is threadedly elevated to expose said open top of said container to facilitate discharge of container-stored product therefrom.

2. The structure as set forth in claim 1 wherein said cap is formed in a zone displaced radially outwardly of said sealing ring means with port means in product flow communication with an interior of said container for discharge of container-stored product therefrom when said cap is threadedly elevated to a product-dispensing mode.

3. The structure as set forth in claim 1 wherein said stop means for preventing separation of said cap from said container comprises:

cap carried rod means for engaging said container and for limiting upward travel of said cap annularly about said neck of said container;

said rod means comprising laterally-projecting means integrally formed with said skirt of said cap and rotatable therewith for vertical travel with said cap along said neck of said container as said cap is drawn threadedly downward on said neck during closure of said open top of said container and as said cap is retracted threadedly upwardly on said neck during venting of the upwardly presented said filling and discharge opening of said container;

fixed abutment means integrally formed with said container and disposed in a path of arcuate travel of said rod means for positive travel-limiting engagement with said rod means during rotation of said cap in establishing an open mode of said filling and discharge opening of said container;

said rotatable rod means and said fixed abutment means constituting means cooperating for preventing separation of said cap physically from said container.

4. The structure as set forth in claim 1 wherein said stop means for preventing separation of said closure cap from said container comprises a protrusion integrally formed with said container at a shoulder zone thereof adjacent a base of said neck of said container, and cap-carried, cooperating wing-like boss means integrally formed with said cap as a radially outwardly projecting extension therefrom at a base thereof, said protrusion being generally arcuately hook-shaped and including a convexly-arched, upwardly and forwardly directed top wall presented to said boss means during assembly of said cap on said container;

said protrusion being resiliently responsive to downwardly exerted compression forces applied thereupon during a tightening advance of said cap on said container to effect a temporary compression and downward displacement of said protrusion and to permit said boss means frictionally to bear upon and cammingly to override said protrusion as said cap is initially threadedly advanced onto and coupled with said container;

said protrusion having a lower wall connected to and opposite and below said top wall;

said lower wall constituting abutment means for confronting and for positively engaging said boss means on said cap to limit rotative displacement of said cap and to obviate separation of said cap from said container.

5. The improvement as set forth in claim 4 wherein said protrusion constitutes a hollow structure integrally formed as an upwardly deformed component of a wall of said container at a shoulder zone thereof.

6. The improvement as set forth in claim 4 wherein said lower wall is of a concave configuration at a face thereof presented to said boss means when said cap is rotated to a mode for dispensing contents from said container.

7. The structure as set forth in claim 1 wherein said stop means includes radially inwardly-directed annular bead-like rim means integrally formed on said skirt of said cap at a base thereof for abuttingly engaging a lower one of said neck-carried thread means and for mechanically limiting upward displacement of said cap when said cap is threadedly elevated in opening said container for dispensing of product contained therein.

8. The structure as set forth in claim 1 wherein said stop means comprises a flange circumscribing and integrally formed with and extending radially outwardly of said neck of said container for limiting upward displacement of said cap during threaded rotation of said cap to an open position of said container.

9. The structure as set forth in claim 8 wherein said upstanding annular wall of said neck of said container is formed at an upper, surmounting limit thereof with a land contacting and defining an annular planar sealing surface extending generally normally of a central axis of said neck; and wherein said port means in said cap is in vertical registering alignment with said land, said land contacting and effectively obstructing and sealing said port means in at least radially inwardly disposed areal zonal sectors thereof for providing a seal between said neck and said cap for preventing discharge of product from said container when said cap is threaded downwardly to establish a closed mode of said container.

10. The structure as set forth in claim 8 wherein said port means comprises a plurality of through openings in a top wall of said cap and spaced annularly about a center of said cap.

11. The structure as set forth in claim 1 and further comprising bristle means carried by and projecting upwardly of said top wall of said cap for application to a surface as scrubbing elements, upon delivery of product from said container.

12. The structure as set forth in claim 1 and further comprising a base flange integrally formed with and circumscribing said neck of said container at a base of said neck, removable locking band means encircling said base flange of said neck of said container and integrally joined to said skirt of said cap at a lower peripheral edge thereof, said locking band means being forcibly severable from said cap to free said cap for threadedly guided upward displacement.

13. The structure as set forth in claim 1 wherein said cap is generally oval in transverse horizontal section, and wherein said top wall of said cap defines an elongate, open-top, generally trough-shaped housing having a base wall and having opposed lateral wall portions embracing and rotatably supporting an applicator;

an applicator housed in said trough and disposed closely to overlie said base wall of said housing;

securement means carried by said wall portions and supporting said applicator for rotation within said housing;

and wherein said port means of said cap comprise through openings in said base wall at a center zone thereof.

14. The structure as set forth in claim 13 and further comprising a plurality of raised, fluid-distributing ribs disposed in an annular array on said base wall and extending radially from a center zone of said base wall, said ribs delineating therebetween areal sectors in which said through openings are formed.

15. The structure as set forth in claim 13 and further comprising a plurality of spacer means carried by said housing for support of said applicator thereon;

said spacer means providing a finite separation between an outer surface of said applicator and a facing surface of said base wall of said trough-shaped housing, thereby to facilitate distribution and transfer of fluid from said container to said applicator and to stabilize and enhance functional rotation of said applicator in said housing.

* * * * *